US008605123B2

(12) United States Patent
Oh et al.

(10) Patent No.: US 8,605,123 B2
(45) Date of Patent: Dec. 10, 2013

(54) METHOD OF DRIVING BACKLIGHT ASSEMBLY AND DISPLAY APPARATUS HAVING THE SAME

(75) Inventors: Won Sik Oh, Asan-si (KR); Youngsup Kwon, Gwangmyeong-si (KR); Hwanwoong Lee, Asan-si (KR); Moonshik Kang, Yongin-si (KR); Jin-Won Jang, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 317 days.

(21) Appl. No.: 12/982,373

(22) Filed: Dec. 30, 2010

(65) Prior Publication Data

US 2011/0249033 A1 Oct. 13, 2011

(30) Foreign Application Priority Data

Apr. 13, 2010 (KR) ..... 10-2010-0033881

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS

| | | | | |
|---|---|---|---|---|
| 7,492,345 | B2 | 2/2009 | Jin et al. | |
| 2005/0231263 | A1 * | 10/2005 | Kawai | 327/514 |
| 2007/0152926 | A1 * | 7/2007 | Kwon | 345/82 |
| 2009/0237007 | A1 * | 9/2009 | Leng | 315/297 |
| 2010/0134522 | A1 * | 6/2010 | De Rijck | 345/690 |

FOREIGN PATENT DOCUMENTS

| | | |
|---|---|---|
| JP | 2001-210122 | 8/2001 |
| JP | 2007-108288 | 4/2007 |
| KR | 1020070115524 | 12/2007 |

* cited by examiner

*Primary Examiner* — Quan-Zhen Wang
*Assistant Examiner* — Nelson D Runkle, III
(74) *Attorney, Agent, or Firm* — F. Chau & Associates, LLC

(57) ABSTRACT

A backlight assembly outputs scan signals having a scanning frequency synchronized with a frame frequency to sequentially drive light emitting blocks providing a light to a display panel. A dimming step of each light emitting block corresponds to one of a plurality of dimming steps in response to local dimming data. A dimming clock having a value obtained by dividing a value obtained by multiplying the scanning frequency and the number is dimming steps by a duty ratio of each scan signal is generated. The dimming step of each light emitting block is counted using the dimming clock, and the counted values are combined with the scan signals to generate dimming signals having a dimming duty ratio corresponding to the dimming step of the light emitting blocks.

19 Claims, 11 Drawing Sheets

METHOD OF DRIVING BACKLIGHT ASSEMBLY AND DISPLAY APPARATUS HAVING THE SAME

CROSS-REFERENCE TO RELATED APPLICATION

This application claims priority to Korean Patent Application No. 2010-33881, filed on Apr. 13, 2010, the disclosure of which is incorporated by reference in its entirety herein.

BACKGROUND

1. Technical Field

Embodiments of the present invention relate to a method of driving a backlight assembly capable of improving display quality and reducing power consumption, and a display apparatus having the backlight assembly.

2. Discussion of Related Art

A liquid crystal display (LCD) is thin, light weight, and uses a small amount of power. Therefore, the LCD is often developed for monitors of notebook computers, desktop computers, cell phones, and TVs. The LCD includes a liquid crystal display panel that controls light transmittance of liquid crystal and a light source disposed below the liquid crystal display to provide the light to the liquid crystal. Unlike a cathode ray tube (CRT), which employs an impulsive driving method having a fast response speed, the LCD is a hold type display device that continuously displays one image during one frame period, with a slow response speed. Thus, the LCD provides a clear image when displaying a still image. However, when displaying a moving picture, the slow response speed of the liquid crystal causes after images or motion blurring on the liquid crystal display panel.

SUMMARY

At least one exemplary embodiment of the present invention provides a method of driving a backlight assembly employing a scanning method and a dimming method to drive a light source.

At least one exemplary embodiment of the present invention provides a display apparatus having the backlight assembly.

According to an exemplary embodiment of the present invention, a backlight assembly includes a plurality of light emitting blocks, a scan signal generator sequentially outputting at least two scan signals having a scanning frequency synchronized with a frame frequency of a display, a dimming step selector selecting a dimming step for each of the light emitting blocks among a plurality of dimming steps in response to local dimming data generated based on an image signal input to the display, a clock generator converting a predetermined reference clock to a dimming clock having a dimming frequency corresponding to multiplying the scanning frequency by the number of dimming steps and then dividing by a duty ratio of each scan signal, and a dimming signal generator counting the dimming step of each of the light emitting blocks using the dimming clock to generate dimming signals based on the counted values and the scan signals.

According to an exemplary embodiment of the invention, a method of driving a backlight assembly having a brightness corresponding to one of a plurality of dimming steps to provide light to a display panel, where the backlight assembly includes at least two light emitting blocks having at least one sub-block includes sequentially outputting at least two scan signals having a scanning frequency synchronized with a frame frequency of the display panel, determining a dimming step of each of the light emitting blocks in response to a local dimming data generated based on an image signal provided to the display panel, converting a predetermined reference clock to a dimming clock having a frequency corresponding to the scanning frequency multiplied by the number of dimming steps and then divided by a duty ratio of each of the scan signals, and counting the dimming step of each of the light emitting blocks using the dimming clock and combining the counted values with the scan signals to generate dimming signals each having a dimming duty ratio corresponding to the dimming step of each of the light emitting blocks.

According to an exemplary embodiment of the invention, a display apparatus includes a backlight assembly and a display panel. The backlight assembly generates a light. The display panel receives the light to display an image corresponding to an image signal. The backlight assembly includes a backlight unit having a plurality of light emitting blocks that sequentially generate a light in synchronization with a frame frequency of the display panel and a backlight control unit controlling an operation of the backlight unit.

The backlight control unit includes a scan signal generator, a dimming step selector, a clock generator, and a dimming signal generator. The scan signal generator sequentially outputs at least two scan signals having a scanning frequency synchronized with the frame frequency, and the dimming step selector selects a dimming step of each of the light emitting blocks among a plurality of dimming steps in response to a local dimming data generated based on the image signal provided to the display panel. The clock generator converts a predetermined reference clock to a dimming clock having a dimming frequency corresponding to multiplying the scanning frequency by the number of dimming steps and then dividing by the duty ratio of each scan signal. The dimming signal generator counts the dimming step of each of the light emitting blocks using the dimming clock and combines the counted values with the scan signals, so that dimming signals having a dimming duty ratio corresponding to the dimming steps of the light emitting blocks are generated.

According to at least one embodiment of the invention, when the frequency of the dimming clock used to count the dimming step according to the duty ratio of each of the scan signals is changed, a scanning method and a dimming method may be simultaneously applied to the backlight assembly to drive the backlight assembly without a distortion of the local dimming data. Thus, power consumption of the display apparatus may be reduced and display quality of the display apparatus may be improved.

BRIEF DESCRIPTION OF THE DRAWINGS

Embodiments of the present invention will become readily apparent by reference to the following detailed description when considered in conjunction with the accompanying drawings wherein.

DESCRIPTION OF EXEMPLARY EMBODIMENTS

It will be understood that when an element or layer is referred to as being "on", "connected to" or "coupled to" another element or layer, it can be directly on, connected or coupled to the other element or layer or intervening elements or layers may be present. Like numbers refer to like elements throughout. Hereinafter, exemplary embodiments of the present invention will be explained in detail with reference to the accompanying drawings.

Figure 1:
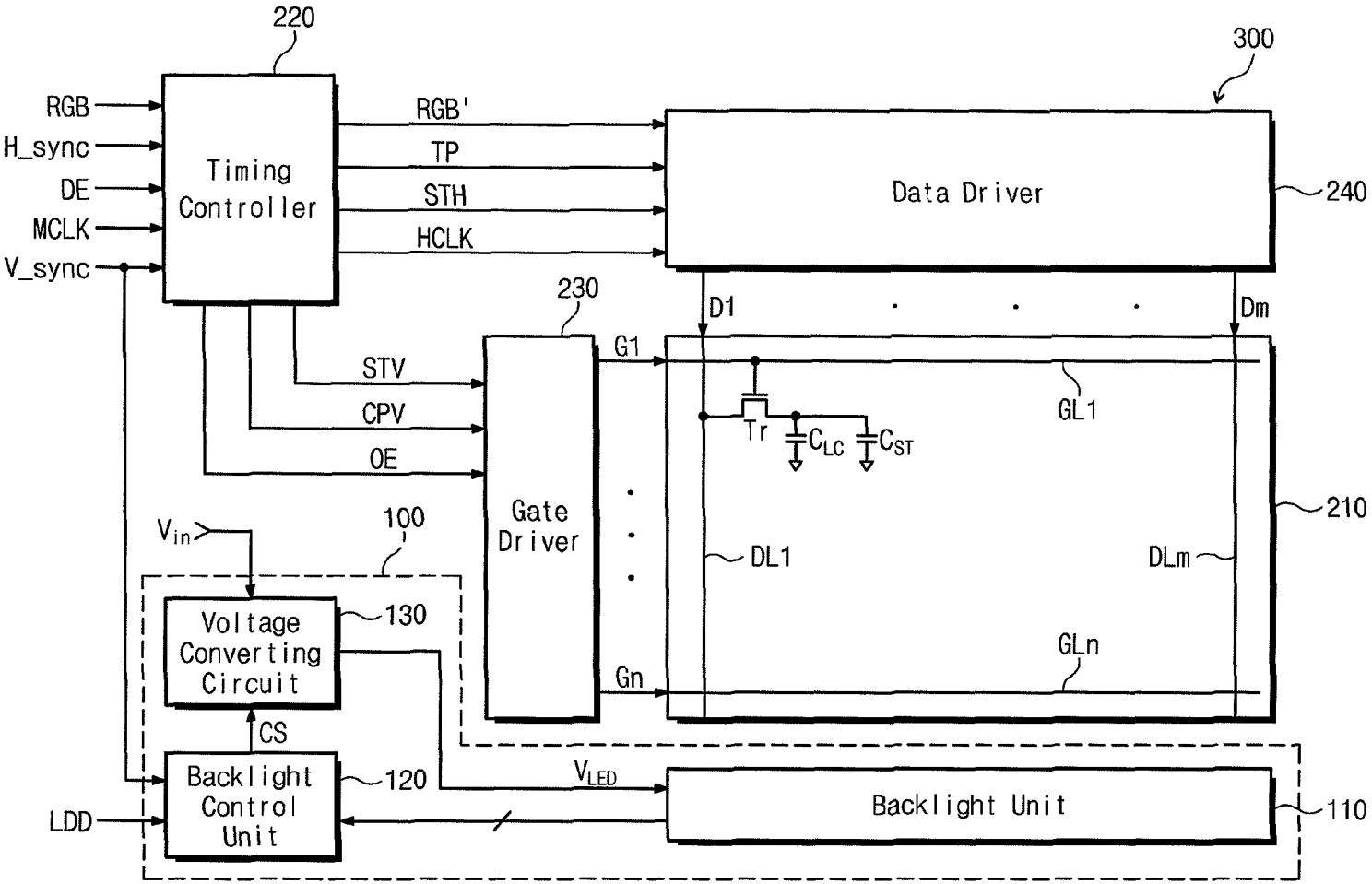
FIG. 1 is a block diagram showing a liquid crystal display according to an exemplary embodiment of the present invention.

FIG. 1 is a block diagram showing a liquid crystal display according to an exemplary embodiment of the present invention. Referring to FIG. 1, a liquid crystal display 300 includes a liquid crystal display panel 210, a timing controller 220, a gate driver 230, a data driver 240, and a backlight assembly 100.

The liquid crystal display panel 210 includes a plurality of gate lines GL1~GLn, a plurality of data lines DL1~DLm crossing the gate lines GL1~GLn, and pixels arranged in the liquid crystal display panel 210. For the convenience of explanation, one pixel has been shown in FIG. 1. Each pixel includes a thin film transistor Tr having a gate electrode connected to a corresponding gate line and a source electrode connected to a corresponding data line, and a liquid crystal capacitor $C_{LC}$ and a storage capacitor $C_{ST}$ connected to a drain electrode of the thin film transistor Tr.

The timing controller 220 receives an image signal RGB, a horizontal synchronization signal H_sync, a vertical synchronization signal V_sync, a clock signal MCLK, and a data enable signal DE from an external device. The timing controller 220 converts a data format of the image signal RGB to a data format appropriate to interface between the timing controller 220 and the data driver 240 and outputs the converted image signal R'G'B' to the data driver 240. Further, the timing controller 220 outputs data control signals, such as an output start signal TP, a horizontal start signal STH, and a clock signal HCLK to the data driver 240 and outputs gate control signals, such as a vertical start signal STV, a gate clock signal CPV, and an output enable signal OE, to the gate driver 230.

The gate driver 230 sequentially applies gate signals G1~Gn to the gate lines GL1~GLn of the liquid crystal display panel 210 in response to the gate control signals STV, CPV and OE provided from the timing controller 220 to sequentially scan the gate lines GL1~GLn.

The data driver 240 generates a plurality of grey-scale voltages using gamma voltages provided from a gamma voltage generator (not shown). The data driver 240 selects grey-scale voltages corresponding to the image signal R'G'B' among the generated grey-scale voltages in response to the data control signals TP, STH and HCLK provided from the timing controller 220 and applies the selected grey-scale voltages to the data lines DL1~DLm of the liquid crystal display panel 210 as data signals D1~Dm.

When the gate signals G1~Gn are sequentially applied to the gate lines GL1~GLn, the data signals D1~Dm are applied to the data lines DL1~DLm in synchronization with the gate signals G1~Gn. When a selected gate line receives a corresponding gate signal, a thin film transistor Tr connected to the selected gate line is turned on in response to the corresponding gate signal. When a data signal is applied to a data line connected to the turned-on thin film transistor Tr, the applied data signal is charged to the liquid crystal capacitor $C_{LC}$ and the storage capacitor $C_{ST}$ through the turned-on thin film transistor Tr.

The liquid crystal capacitor $C_{LC}$ controls a light transmittance of a liquid crystal according to the charged voltage therein. The storage capacitor $C_{ST}$ stores the data signal when the thin film transistor Tr1 is turned on and applies the stored data signal to the liquid crystal capacitor $C_{LC}$ when the thin film transistor Tr1 is turned off to maintain the liquid crystal capacitor $C_{LC}$ in the charged state. The liquid crystal display panel 210 may display the image through the above stated method.

The backlight assembly 100 includes a backlight unit 110 arranged at a rear of the liquid crystal display panel 210 to provide a light to the liquid crystal display panel 210, a voltage converting circuit 130 providing a driving voltage $V_{LED}$ to the backlight unit 110, and a backlight control unit 120 controlling an on/off operation of the backlight unit 110.

Figure 2:
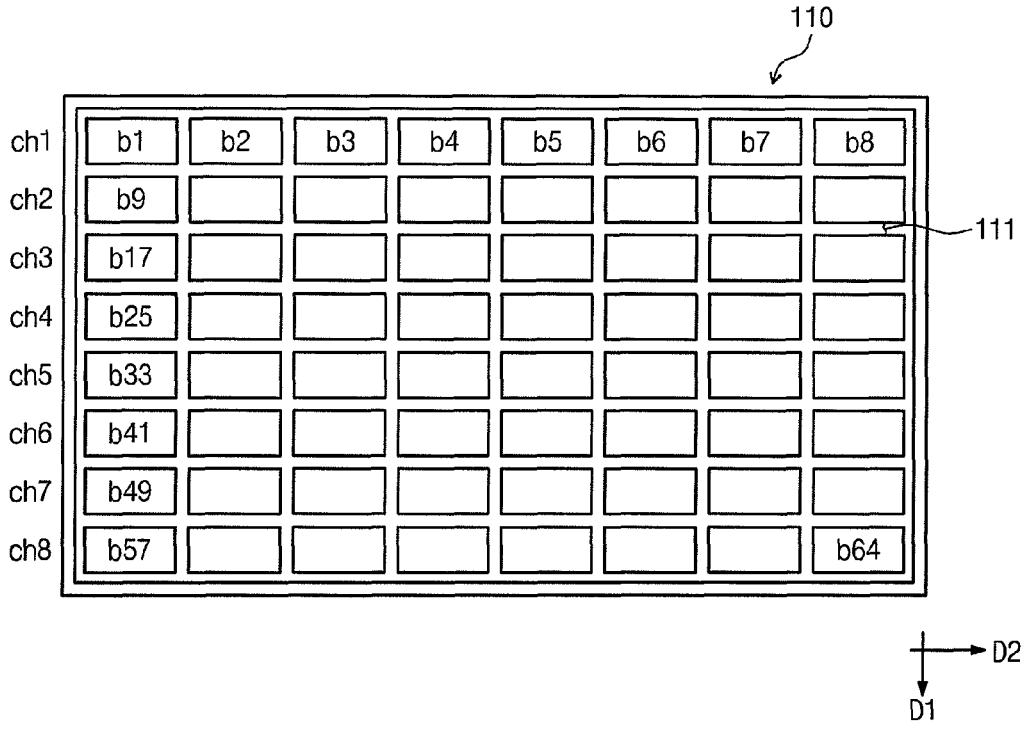
FIG. 2 is an exemplary plan view showing a backlight unit of FIG. 1.
Figure 3:
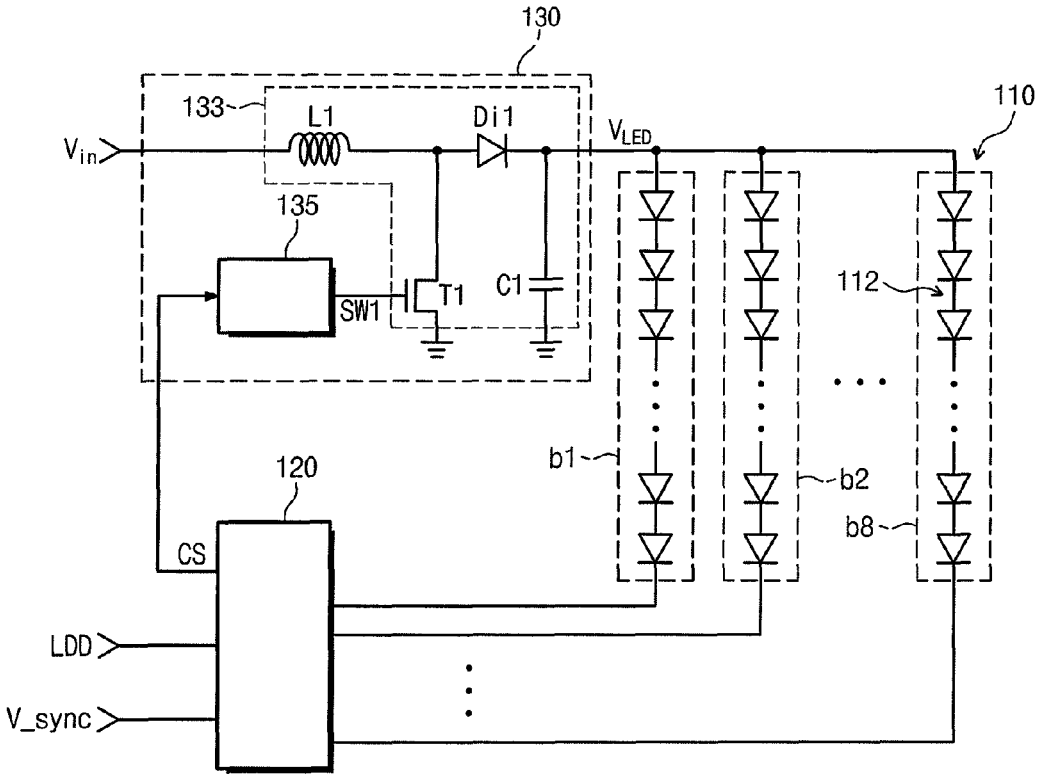
FIG. 3 is a block diagram showing the backlight unit, a voltage converting circuit, and a backlight control unit of FIG. 1 according to an exemplary embodiment of the invention.

FIG. 2 is an exemplary plan view showing a backlight unit of FIG. 1, and FIG. 3 is a block diagram showing embodiments of the backlight unit 110, the voltage converting 130 circuit, and the backlight control unit 120, and exemplary connections therebetween.

Referring to FIG. 2, the backlight unit 110 includes a printed circuit board 111 corresponding to the liquid crystal display panel 210 and a plurality of light sources 112 arranged on the printed circuit board 111.

The backlight unit 110 includes N (N is a natural number larger than 1) light emitting blocks (e.g., ch1~ch8) arranged in a first direction D1. In at least one exemplary embodiment, the backlight unit 110 may include eight light emitting blocks ch1~ch8 (hereinafter, referred to as first to eighth light emitting blocks). In addition, each of the light emitting blocks ch1~ch8 may be divided into J (J is a natural number larger than 1) sub-blocks (e.g., b1~b8) arranged in a second direction D2 that is substantially perpendicular to the first direction D1. In at least one exemplary embodiment, each of the light emitting blocks ch1~ch8 includes eight sub-blocks b1~b8. Thus, sixty-four sub-blocks b1~b64 may be arranged in the backlight unit 110 in total. However, in alternate embodiments, the backlight unit 110 may include a lesser or greater number of light emitting blocks and each light emitting block may include a lesser or greater number of sub-blocks.

The first to eighth sub-blocks b1~b8 have been shown in FIG. 3, however the remaining ninth to sixty-fourth sub-blocks b9~b64 have the same structure and function as the first to eighth sub-blocks b1~b8. The first to eighth sub-blocks b1~b8 are connected in parallel to each other, and each of the first to eighth sub-blocks b1~b8 includes at least one light source. When each of the first to eighth sub-blocks b1~b8 includes two or more light sources, the light sources may be connected to each other in series. Each light source 112 may be a light emitting diode (LED).

The voltage converting circuit 130 includes a direct current-to-direct current (DC/DC) converter 133 converting an input voltage Vin, for example, of about 12V to output the driving voltage $V_{LED}$ and a control circuit 135 controlling the DC/DC converter 133.

The DC/DC converter 133 may include a coil (inductor) L1, a diode Di1, a capacitor C1, and a transistor T1 (hereinafter, referred to as switching device). The transistor T1 includes a control terminal (gate) connected to the control circuit 135 to receive a switching signal SW1.

The switching device T1 is turned on or turned off in response to the switching signal SW1, and the coil L1 boosts up the input voltage Vin according to the on/off operation of the switching device T1. Thus, a voltage level of the driving voltage $V_{LED}$ output from the DC/DC converter 133 may vary according to a duty ratio of the switching signal SW1.

For example, when the duty ratio of the switching signal SW1 decreases, the voltage level of the driving voltage $V_{LED}$ output from the DC/DC converter 133 decreases. Alternately, the voltage level of the driving voltage $V_{LED}$ increases as the duty ratio of the switching signal SW1 increases. In at least one exemplary embodiment of the invention, the driving voltage $V_{LED}$ may have voltage level of about 20V to about 35V.

The backlight control unit 120 is connected to an output terminal of each of the first to eighth sub-blocks b1~b8 to apply a control signal CS to the control circuit 135 to control the duty ratio of the switching signal SW1 based on a current value feedback from each of the first to eighth sub-blocks b1~b8.

Further, the backlight control unit 120 receives the vertical synchronization signal V_sync and a local dimming data LDD from an external source to control brightness of each of the first to eighth sub-blocks b1~b8.

Figure 4:
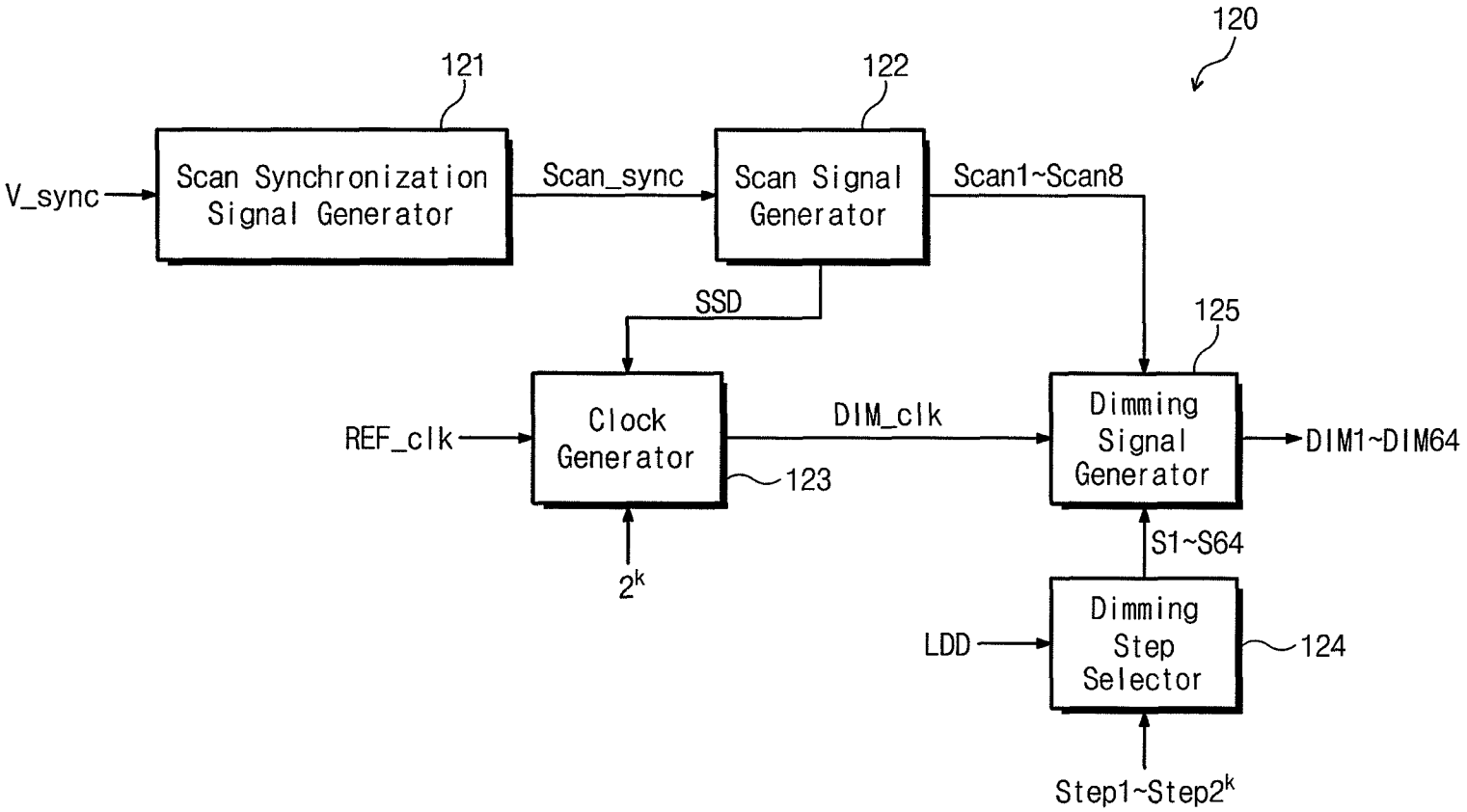
FIG. 4 is a block diagram showing a backlight control unit of FIG. 2 according to an exemplary embodiment of the invention.

FIG. 4 is a block diagram showing the backlight control unit of FIG. 2 according to an exemplary embodiment of the invention. Referring to FIG. 4, the backlight control unit 120 includes a scan synchronization signal generator 121, a scan signal generator 122, a clock generator 123, a dimming step selector 124, and a dimming signal generator 125.

The scan synchronization signal generator 121 receives the vertical synchronization signal V_sync. The vertical synchronization signal V_sync is used to determine a frame period of the liquid crystal display panel 210. Hereinafter, a frequency of the vertical synchronization signal V_sync is referred to as a frame frequency 1 FHz. The frame frequency 1 FHz may be set to, for example, about 60 Hz, 120 Hz, 240 Hz, etc.

The scan synchronization signal generator 121 outputs a scan synchronization signal Scan_sync to control a scan timing of each of the light emitting blocks ch1~ch8 based on the vertical synchronization signal V_sync. A frequency of the scan synchronization signal Scan_sync depends upon the number of the light emitting blocks ch1~ch8. As shown in FIG. 2, when the backlight unit 110 includes eight light emitting blocks ch1~ch8, the scan synchronization signal Scan_sync has the frequency corresponding to eight times the frame frequency 1 FHz.

The scan signal generator 122 generates first to eighth scan signals Scan1~Scan8 based on the scan synchronization signal Scan_sync, and the first to eighth scan signals Scan1~Scan8 are sequentially applied to the first to eighth light emitting blocks ch1~ch8.

The dimming step selector 124 selects a dimming step of each of the sub-blocks b1~b64 among predetermined P (for example, P may be $2^k$, where P and k are larger than 1) dimming steps Step 1~Step $2^k$ based on the local dimming data LDD. The local dimming data LDD is calculated based on the image signal R'G'B' applied to a predetermined dimming area of the liquid crystal display panel 210 corresponding to the sub-blocks b1~b64. As an example, the local dimming data LDD may be an average grey-scale value of the image signal R'G'B' applied to each of the dimming areas.

For example, when the dimming step is presented as an 8-bit signal (i.e., the k is 8), the dimming step selector 124 may receive 256 dimming steps (i.e., the P is 256). In another example, where the dimming step is presented as a 10-bit signal (i.e., the k is 10), the dimming step selector 124 may receive 1024 dimming steps (i.e., the P is 1024).

The dimming step selector 124 selects a dimming step corresponding to the local dimming data LDD as a dimming step of a corresponding sub-block. The selected dimming steps S1~S64 of the sub-blocks b1~b64 are applied to the dimming signal generator 125.

The clock generator 123 receives a reference clock REF_clk having a predetermined frequency and converts the reference clock REF_clk to a dimming clock DIM_clk based on the duty ratio of each of the scan signals Scan1~Scan8 and the number of the dimming steps (that is, the P). For example, the dimming clock DIM_clk has a dimming frequency corresponding to a value obtained by dividing a value obtained by multiplying the frame frequency 1 FHz and the P by the duty ratio SDD of each of the scan signals Scan1~Scan8.

The dimming signal generator 125 counts the dimming steps S1~S64 corresponding to each of the sub-blocks b1~b64 using the dimming clock DIM_clk. Further, the dimming signal generator 125 receives the first to eighth scan signals Scan1~Scan8 and applies the counted values to each of the first to eighth scan signals Scan1~Scan8 to output first to sixty-fourth dimming signals DIM1~DIM64 to be applied to the sub-blocks b1~b64.

Hereinafter, an operation of the backlight control unit 120 shown in FIG. 3 will be described with reference to a timing diagram.

Figure 5:
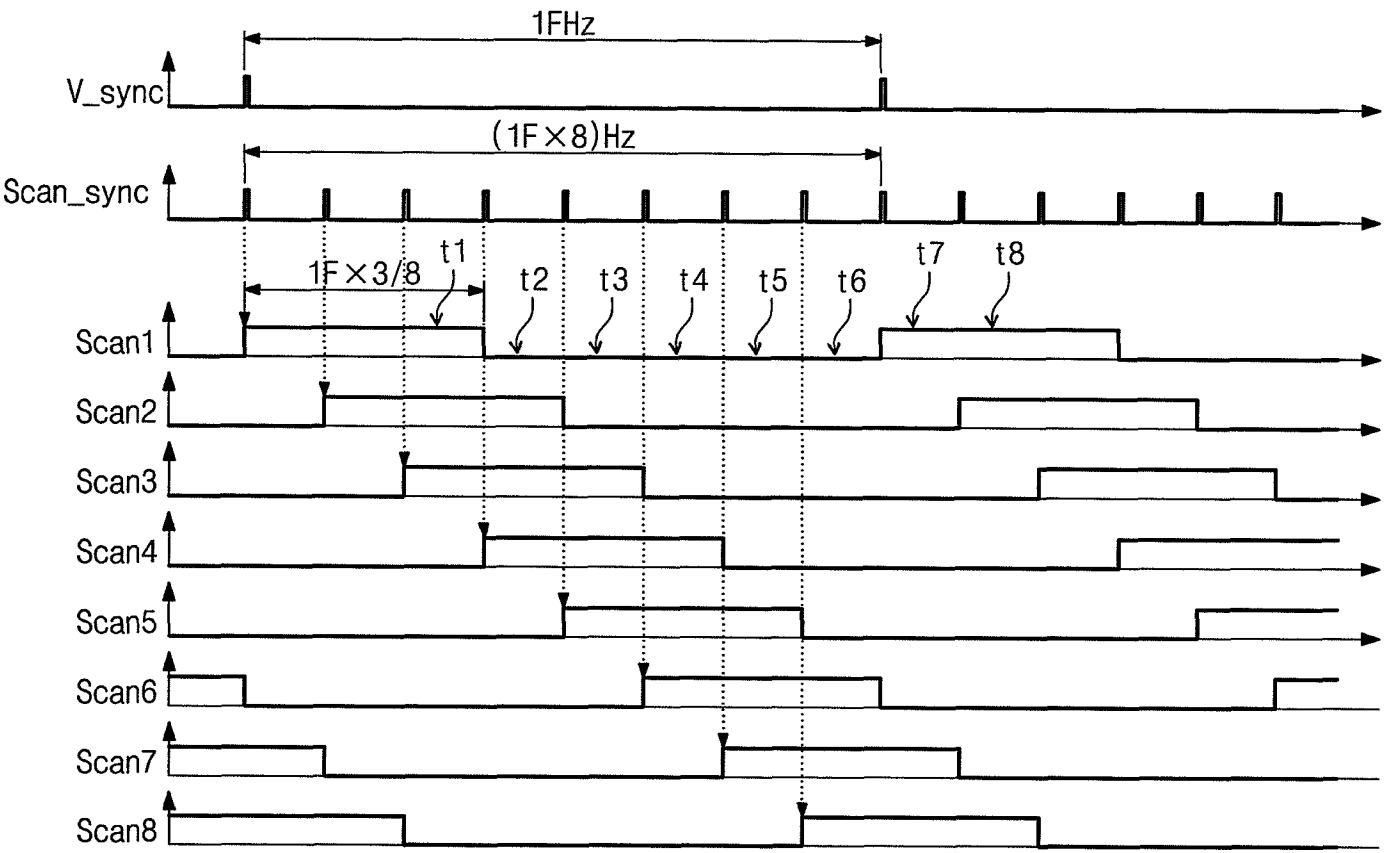
FIG. 5 is an exemplary timing diagram showing a vertical synchronization signal, a scan synchronization signal, and first to eighth scan signals of FIG. 4.

FIG. 5 is an exemplary timing diagram showing the vertical synchronization signal V_sync, the scan synchronization signal Scan_sync, and the first to eighth scan signals Scan1-Scan8 of FIG. 4. Referring to FIGS. 4 and 5, the vertical synchronization signal V_sync is used to determine the frame period of the liquid crystal display panel 210 and may have a frame frequency of, for example, about 60 Hz, about 120 Hz, or about 240 Hz.

The scan synchronization signal Scan_sync has the frequency (1F×8 Hz) corresponding to eight times the frame frequency 1 FHz to control the scan timing of each of the light emitting blocks ch1~ch8.

The scan signal generator 122 generates the first to eighth scan signals Scan1~Scan8 based on the scan synchronization signal Scan_sync to sequentially apply the first to eighth scan signals Scan1~Scan8 to the first to eighth light emitting blocks ch1~ch8. As shown in FIG. 5, each of the first to eighth scan signals Scan1~Scan8 is successively output with a predetermined time interval. For example, two scan signals adjacent each other have a phase difference corresponding to ⅛th of one frame period 1F.

In addition, each of the first to eighth scan signals Scan1~Scan8 has a duty ratio larger than 0 and smaller than 1. As an example of at least one exemplary embodiment, each of the first to eighth scan signals Scan1~Scan8 may have a higher period corresponding to ⅜ths of the one frame period 1F. Therefore, the higher periods of the two scan signals adjacent each other among the first to eighth scan signals Scan1~Scan8 may partially overlap with each other.

Figure 6:
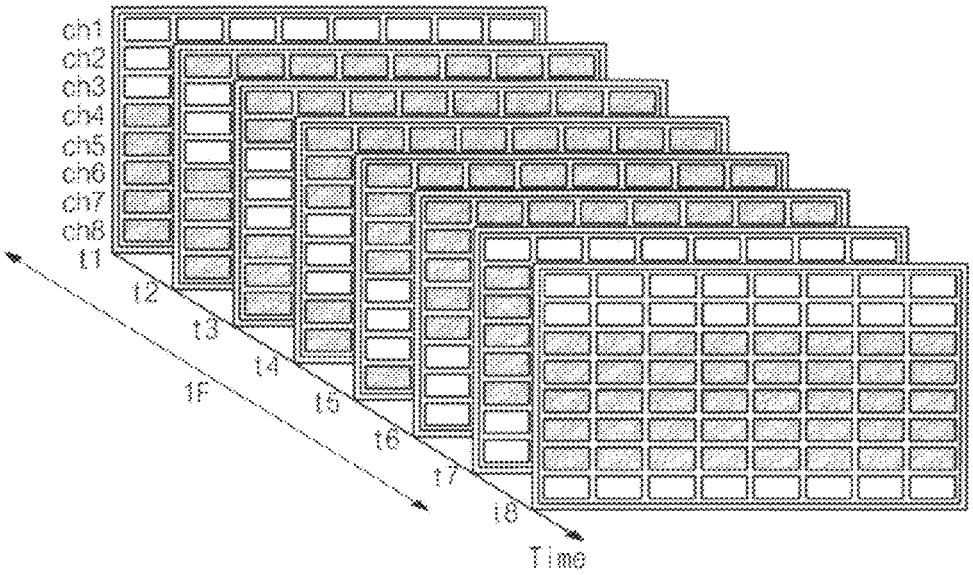
FIG. 6 is an exemplary view showing a driving timing of light emitting blocks of the backlight control unit of FIG. 3 sequentially operated in response to the first to eighth scan signals of FIG. 5.

FIG. 6 is a view showing an exemplary driving timing of light emitting blocks sequentially operated in response to the first to eighth scan signals of FIG. 5. Referring to FIGS. 5 and 6, the first, second, and third light emitting blocks ch1, ch2, and ch3 among the first to eighth light emitting blocks ch1~ch8 are turned on at a first timing t1. Then, the second, third, and fourth light emitting blocks ch2, ch3, and ch4 are turned on at a second timing t2, and the third, fourth, and fifth light emitting blocks ch3, ch4, and ch5 are turned on at a third timing t3, etc.

Through the above-stated procedure, the first to eighth light emitting blocks ch1~ch8 are shifted one by one from the first timing t1 during one frame period 1F, and thus the first to eighth light emitting blocks ch1~ch8 may be sequentially turned on.

Figure 7:
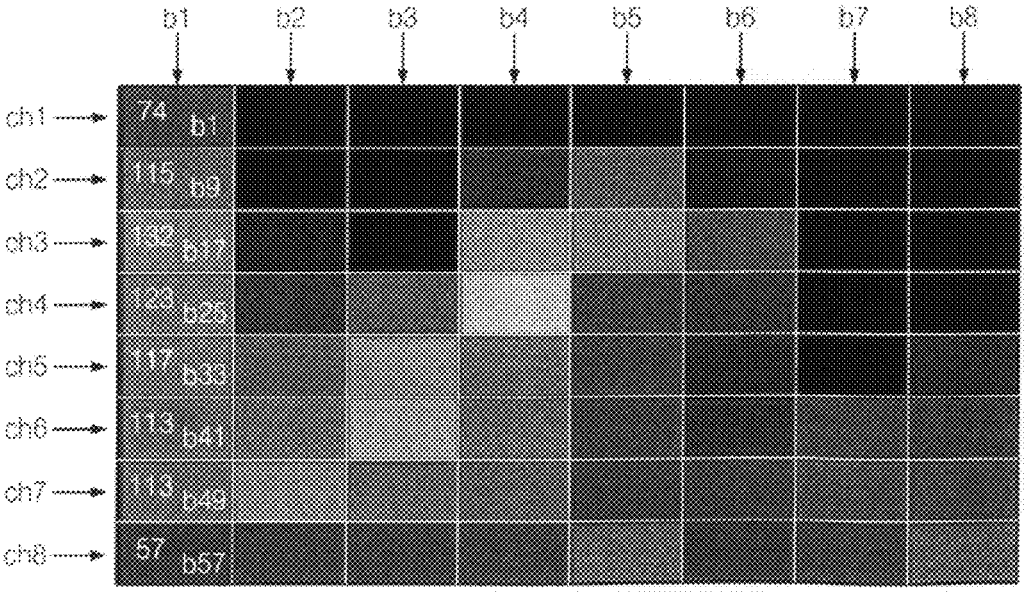
FIG. 7 is an exemplary view showing a brightness of each sub-block of the backlight unit of FIG. 3.
Figure 8:
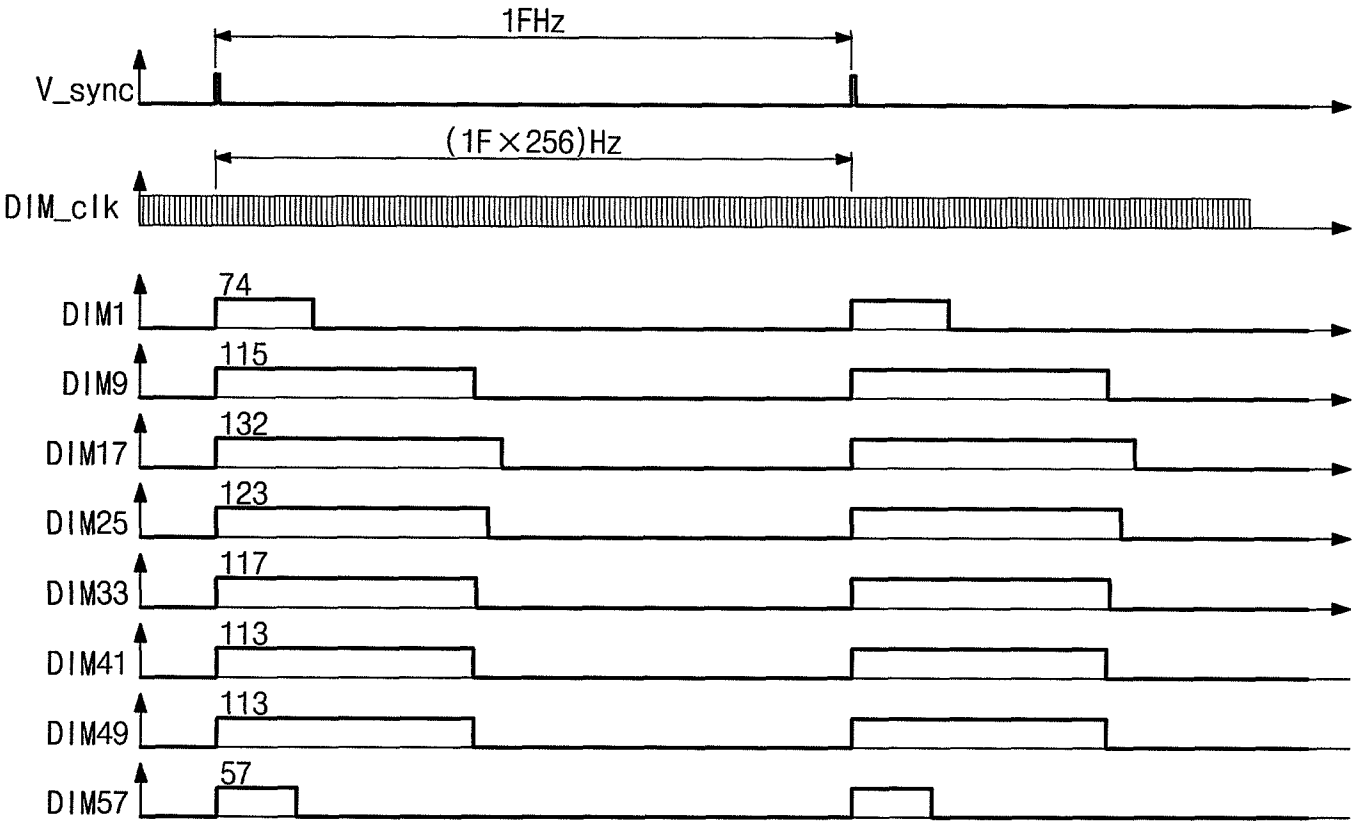
FIG. 8 is an exemplary timing diagram showing dimming signals corresponding to first sub-blocks of first to eighth light emitting blocks of FIG. 7.

FIG. 7 is a view showing a brightness of each sub-block of the backlight unit of FIG. 3 and FIG. 8 is a timing diagram showing dimming signals corresponding to first sub-blocks of the first to eighth light emitting blocks of FIG. 7.

Referring to FIG. 7, each of the sub-blocks b1~b64 of the backlight unit 110 has a brightness different from each other according to the image signal applied to a corresponding dimming area of the liquid crystal display panel 210. For convenience of explanation, the dimming steps of the first sub-blocks b1, b9, b17, b25, b33, b41, b49, and b57 of the first to eighth light emitting blocks ch1~ch8 have been shown in FIG. 7.

As shown in FIG. 7, in one example when the dimming step selector 124 receives 256 dimming steps, the first sub-block b1 has 74 dimming steps, the ninth sub-block b9 has 115 dimming steps, and the seventeenth sub-block b17 has 132 dimming steps. Further, the twenty-fifth sub-block b25 has 123 dimming steps, the thirty-third sub-block b33 has 117 dimming steps, the forty-fourth sub-block b41 and the forty-ninth sub-block b49 have 113 dimming steps, and the fifty-seventh sub-block b57 has 57 dimming steps.

Referring to FIG. 8, in an example where the scan synchronization signal Scan_sync is not applied to the clock generator 123, the clock generator 123 may output the dimming clock DIM_clk having a dimming frequency (1F×256 Hz) corresponding to 256 times the frame frequency 1 FHz. For example, the dimming clock DIM_clk may have 256 high periods during the one frame period 1F.

When this occurs, the dimming signal generator 125 counts the dimming steps of each of the sub-blocks b1~b64 using the dimming clock DIM_clk to generate dimming signals DIM1~DIM64 respectively corresponding to the sub-blocks b1~b64.

As shown in FIG. 8, in an example where the first sub-block b1 has 74 dimming steps, the dimming signal generator 125 counts the dimming clock DIM_clk from a start timing of the one frame period 1F and generates the first dimming signal DIM1 having a high period until the counted value of the dimming clock DIM_clk reaches 74.

When the ninth sub-block b9 has 115 dimming steps, the dimming signal generator 125 counts the dimming clock DIM_clk from the start timing of the one frame period 1F and generates a ninth dimming signal DIM9 having a high period until the counted value of the dimming clock DIM_clk reaches 115.

Similarly, seventeenth, twenty-fifth, thirty-third, forty-first, forty-ninth, and fifty-seventh dimming signals DIM17, DIM25, DIM33, DIM 41, DIM49, and DIM 57 corresponding to the seventeenth, twenty-fifth, thirty-third, forty-first, forty-ninth, and fifty-seventh sub-blocks b17, b25, b33, b41, b49, and b57 may be generated.

Figure 9:
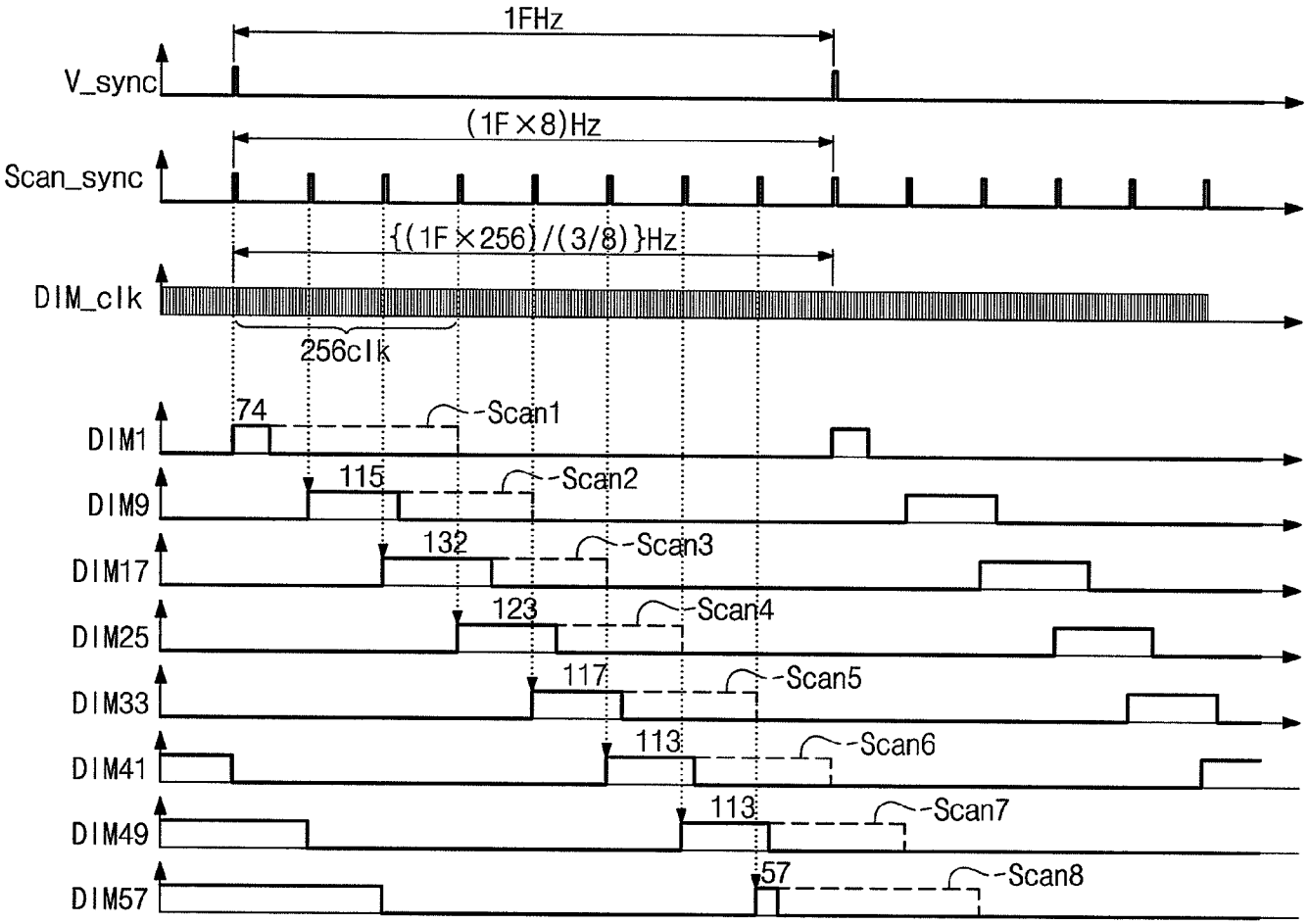
FIG. 9 is an exemplary timing diagram showing driving signals corresponding to first sub-blocks of the first to eighth light emitting blocks of FIG. 7.

FIG. 9 is an exemplary timing diagram showing driving signals corresponding to first sub-blocks of the first to eighth light emitting blocks. Referring to FIG. 9, when the number of the dimming steps is 256 and each of the scan signals Scan1~Scan8 has a duty ratio corresponding to ⅜ths of one frame period 1F, the dimming clock DIM_clk has a dimming frequency corresponding to a value {(1F×256)/(⅜)} obtained by dividing a value obtained by multiplying the frame frequency 1 FHz and 256 by ⅜. As a result, the dimming clock DIM_clk may have 256 high periods 256 clk during the high period of each of the scan signals Scan1~Scan8.

The dimming signal generator 125 counts the dimming steps of each of the sub-blocks b1~b64 using the dimming clock DIM_clk to generate dimming signals DIM1~DIM64 respectively corresponding to the sub-blocks b1~b64.

As shown in FIG. 9, when the first sub-block b1 has 74 dimming steps, the dimming signal generator 125 sets a period from a rising timing a1 of the first scan signal Scan1 to a time point when the 74 dimming clocks DIM_clk are generated to the high period of the first dimming signal DIM1.

When the ninth sub-block b9 has 115 dimming steps, the dimming signal generator 125 sets a period from a rising timing a2 of the second scan signal Scan2 to a time point at which the 115 dimming clocks DIM_clk are generated to the high period of the ninth dimming signal DIM9.

Similarly, the dimming signal generator 125 may set the high period of the seventeenth, twenty-fifth, thirty-third, forty-first, forty-ninth, and fifty-seventh dimming signals DIM17, DIM25, DIM33, DIM 41, DIM49, and DIM 57 respectively applied to the seventeenth, twenty-fifth, thirty-third, forty-first, forty-ninth, and fifty-seventh sub-blocks b17, b25, b33, b41, b49, and b57.

As described above, when the frequency of the dimming clock DIM_clk used to count the dimming steps is changed according to the duty ratio of each of the scan signals Scan1~Scan8, a scanning method and a dimming method may be simultaneously applied to the backlight assembly 100 without a distortion of the local dimming data LDD.

Figure 10:
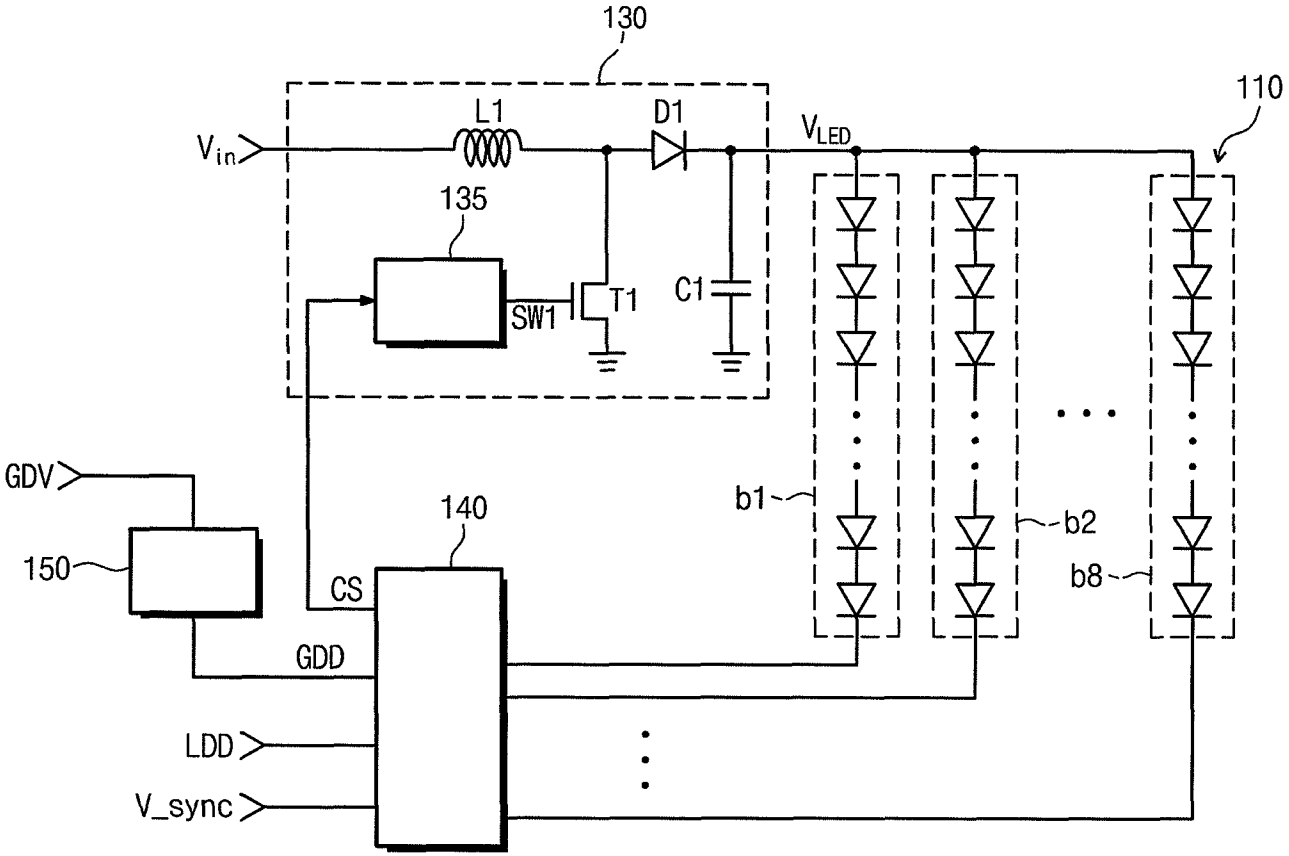
FIG. 10 is a block diagram showing a backlight assembly according to an exemplary embodiment of the present invention.

FIG. 10 is a block diagram showing a backlight assembly according to an exemplary embodiment of the present invention. In FIG. 10, the same reference numerals denote the same elements in FIG. 3, and thus the detailed descriptions of the same elements will be omitted.

Referring to FIG. 10, a backlight assembly 100 further includes a global dimming part 150 to convert an externally provided global dimming voltage GDV to a global dimming signal GDD in a digital format. In at least one exemplary embodiment, a voltage level of the global dimming voltage GDV may be controlled by a user's operation. For example, the user may increase the voltage level of the global dimming voltage GDV improve the brightness of the backlight unit 110 and may decrease the voltage level of the global dimming voltage GDV to decrease the brightness of the backlight unit 110. The global dimming signal GDD output from the global dimming part 150 is applied to a backlight control unit 140.

Figure 11:
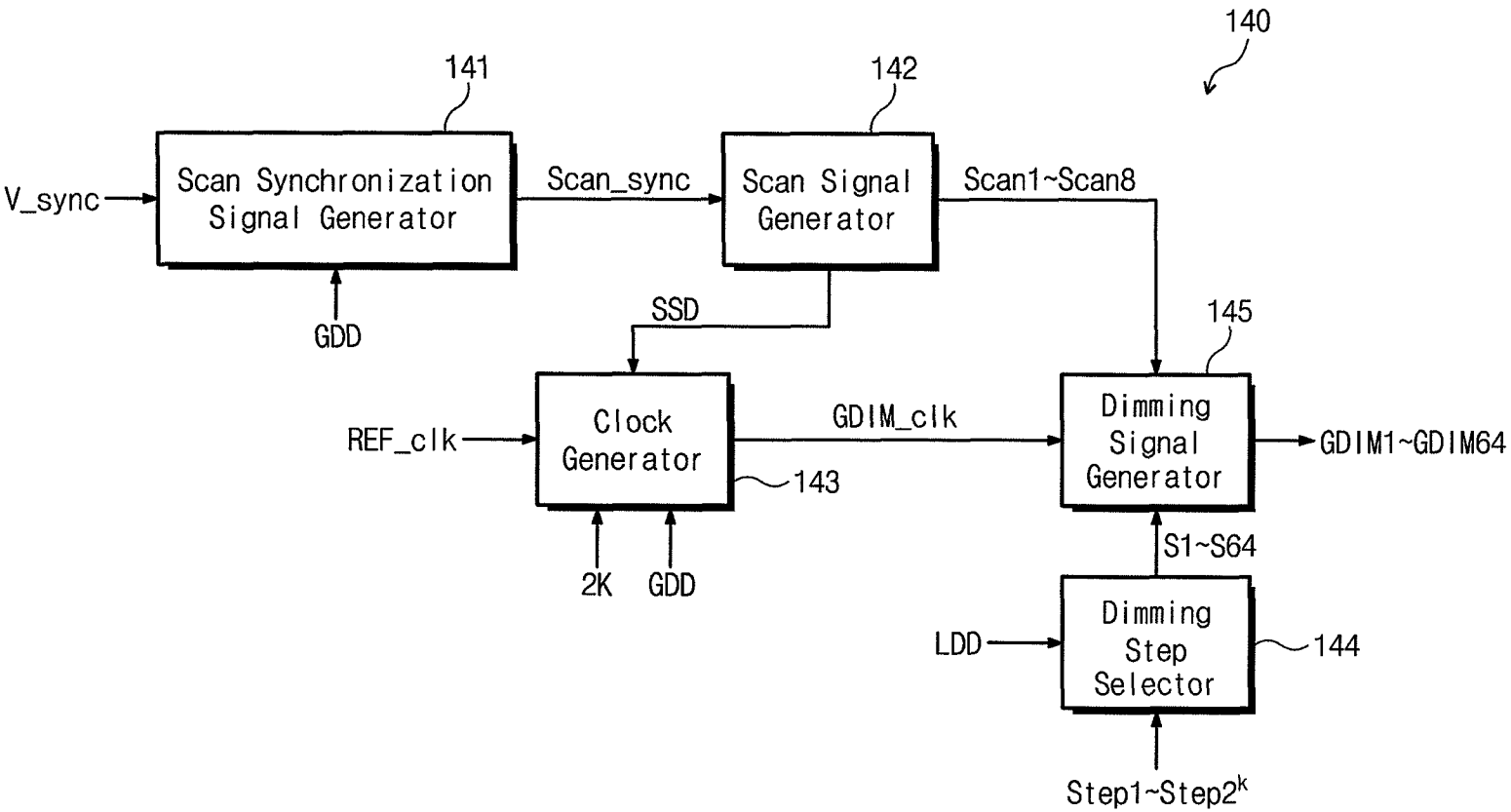
FIG. 11 is a block diagram showing a backlight control unit of FIG. 10 according to an exemplary embodiment of the invention.
Figure 12:
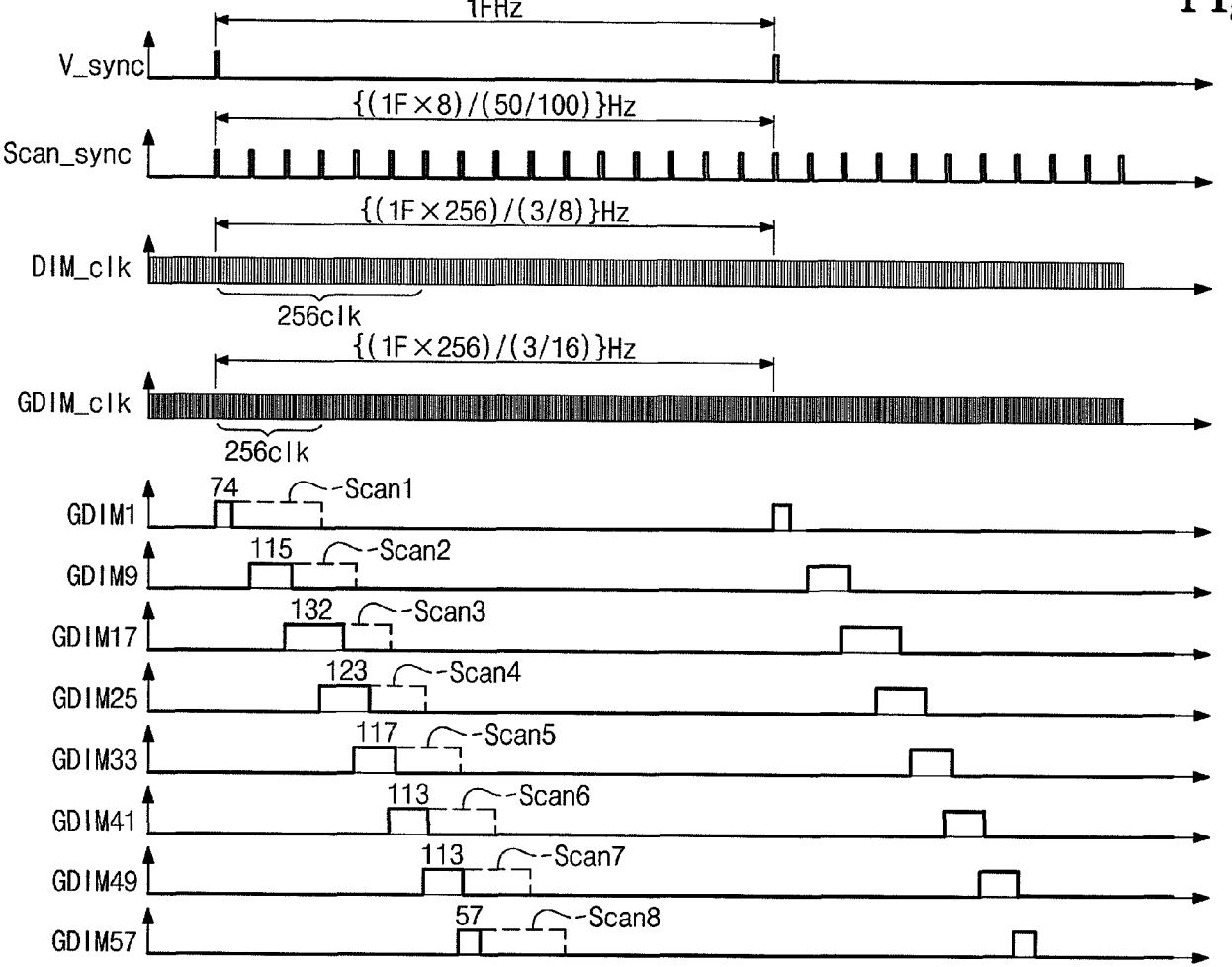
FIG. 12 is an exemplary timing diagram showing dimming signals corresponding to first sub-blocks of first to eighth light emitting blocks among the dimming signals shown in FIG. 11.

FIG. 11 is a block diagram showing the backlight control unit of FIG. 10, and FIG. 12 is a timing diagram showing dimming signals corresponding to first sub-blocks of first to eighth light emitting blocks among the dimming signals shown in FIG. 11.

Referring to FIGS. 11 and 12, a scan synchronization signal generator 141 and a clock generator 143 of the backlight control unit 140 receive the global dimming signal GDD. The scan synchronization signal generator 141 outputs a scan synchronization signal Scan_sync to control a scan timing of each light emitting block ch1~ch8 based on a vertical synchronization signal V_sync and the global dimming signal GDD. For example, a frequency of the scan synchronization signal Scan_sync depends upon the number of the light emitting blocks ch1~ch8 and a duty ratio of the global dimming signal GDD.

As shown in FIG. 12, when the backlight unit 110 includes eight light emitting blocks ch1~ch8 and the global dimming signal GDD has a duty ratio of about 50%, the scan synchronization signal Scan_sync may have a frequency $\{(1F\times 8)/(50/100)\}$ corresponding to a value obtained by dividing a value obtained by multiplying a frame frequency 1 FHz and 8 by $50/100$.

The scan signal generator 142 generates first to eighth scan signals Scan1~Scan8 based on the scan synchronization signal Scan_sync and sequentially applies the first to eighth scan signals Scan1~Scan8 to the first to eighth light emitting blocks ch1~ch8. Thus, a duty ratio of the first to eighth scan signals Scan1~Scan8 depends upon the duty ratio of the global dimming signal GDD. When the global dimming signal GDD has a duty ratio of about 50%, each of the first to eighth scan signals Scan1~Scan8 has a duty ratio corresponding to a value obtained by dividing a value obtained by multiplying one frame period 1F and the duty ratio of the global dimming signal GDD (1F×50%) by $3/8$.

The clock generator 143 receives a reference clock REF_clk having a predetermined frequency and converts the reference clock REF_clk to a dimming clock GDIM_clk based on the duty ratio of each of the scan signals Scan1~Scan8 and the number of the dimming steps (e.g., P steps).

For example, the dimming clock GDIM_clk has a dimming frequency corresponding to a value obtained by dividing a value obtained by multiplying the frame frequency 1 FHz and the P by the duty ratio SDD of each of the scan signals Scan1~Scan8.

When the number of the dimming steps is about 256 and each of the scan signals Scan1~Scan8 has the duty ratio $(1F\times(3/16))$ corresponding to a value obtained by dividing a value obtained by multiplying one frame period 1F and the duty ratio (50%) by $3/8$, the dimming clock GDIM_clk has the dimming frequency $((1F\times 256)/(3/16))$ corresponding to a value obtained by dividing a value obtained by multiplying the frame frequency 1 FHz and 256 by the duty ratio $(1F\times(3/16))$ of each of the scan signals Scan1~Scan8. Consequently, the dimming clock GDIM_clk may have 256 high periods during a high period of each of the scan signals Scan1~Scan8.

The dimming signal generator 145 counts the dimming steps of each sub-block b1~b64 using the dimming clock GDIM_clk to generate dimming signals GDIM1~GDIM64 corresponding to the sub-blocks b1~b64, respectively.

As shown in FIG. 12, when the first sub-block b 1 has 74 dimming steps, the dimming signal generator 145 sets a period from a rising timing a1 of a first scan signal Scan1 to a time point at which 74 dimming clocks GDIM_clk are generated to a high period of a first dimming signal GDIM1.

When the ninth sub-block b9 has 115 dimming steps, the dimming signal generator 145 sets a period from a rising timing a2 of a second scan signal Scan2 to a time point at which 115 dimming clocks GDIM_clk are generated to a high period of a ninth dimming signal GDIM9.

Similarly, the dimming signal generator 145 may set the high period of seventeenth, twenty-fifth, thirty-third, forty-first, forty-ninth, and fifty-seventh dimming signals GDIM17, GDIM25, GDIM33, GDIM 41, GDIM49, and GDIM 57 respectively applied to seventeenth, twenty-fifth, thirty-third, forty-first, forty-ninth, and fifty-seventh sub-blocks b17, b25, b33, b41, b49, and b57.

According to at least one embodiment of the invention, when the frequency of the dimming clock GDIM_clk used to count the dimming steps is changed according to the duty ratio of each of the scan signals Scan1~Scan8, the scanning method and the dimming method may be simultaneously applied to the backlight assembly 100 without the distortion of the local dimming data LDD.

Although exemplary embodiments of the present invention have been described, it is to be understood that the present invention is not limited to these exemplary embodiments and various changes and modifications can be made by one ordinary skilled in the art within the spirit and scope of the disclosure.

What is claimed is:

1. A method of driving a backlight assembly having a brightness corresponding to one of a plurality of dimming steps to provide light to a display panel, the backlight assembly comprising at least two light emitting blocks having at least one sub-block, the method comprising:

sequentially outputting at least two scan signals having a scanning frequency synchronized with a frame frequency of the display panel;

determining a dimming step of each of the light emitting blocks in response to local dimming data generated based on an image signal provided to the display panel;

converting a predetermined reference clock to a dimming clock, wherein a frequency of the dimming clock is a result of the scanning frequency being multiplied by the number of dimming steps and then being divided by a duty ratio of each of the scan signals;

counting the dimming step of each of the light emitting blocks using the dimming clock and combining the counted values with the scan signals to generate dimming signals each having a dimming duty ratio corresponding to the dimming step of each of the light emitting blocks;

receiving a global dimming signal to control an overall brightness of the backlight assembly; and adjusting the frequency of the dimming clock based on a duty ratio of the global dimming signal, wherein each of the at least two scans is successively output with a predetermined time interval and each of the dimming signals is set to a high level in response to a rising timing edge of a corresponding scan signal among the at least two scan signals, and wherein a first one of the scan signals has a first riding edge, a sequential second one of the scan signals has a second rising edge after the first rising edge, a first one of the dimming signals transitions to a high level at the first rising edge, and a sequential second one of the dimming signals transitions to the high level at the second rising edge.

2. The method of claim 1, wherein each of the scan signals has a duty ratio larger than 0 and smaller than 1.

3. The method of claim 2, wherein two scan signals adjacent each other have a phase difference corresponding to 1/N times one frame period, wherein N is the number of the scan signals.

4. The method of claim 1, wherein the dimming clock has a frequency corresponding to a first value divided by a second value, the first value obtained by multiplying the scanning frequency and the number of dimming steps, and the second value obtained by multiplying the duty ratio of each scan signal and the duty ratio of the global dimming signal.

5. A display apparatus comprising:

a backlight assembly generating a light; and a display panel receiving the light to display an image corresponding to an image signal, wherein the backlight assembly comprises:

a backlight unit including a plurality of light emitting blocks that sequentially generate a light in synchronization with a frame frequency of the display panel; and a backlight control unit controlling an operation of the backlight unit, wherein the backlight control unit comprises:

a scan signal generator sequentially outputting at least two scan signals having a scanning frequency synchronized with the frame frequency;

a dimming step selector selecting a dimming step for each of the light emitting blocks among a plurality of dimming steps in response to local dimming data generated based on the image signal provided to the display panel;

a clock generator converting a predetermined reference clock to a dimming clock, wherein a frequency of the dimming clock is a result of the scanning frequency being multiplied by the number of dimming steps and then being divided by the duty ratio of each scan signal wherein the clock generator receives a global dimming signal to control an overall brightness of the backlight assembly and adjusts the frequency of the dimming clock based on a duty ratio of the global dimming signal; and a dimming signal generator counting the dimming step of each of the light emitting blocks using the dimming clock and combining the counted values with the scan signals to generate dimming signals having a dimming duty ratio corresponding to the dimming step of each of the light emitting blocks, wherein each of the at least two scan signals is successively output with a predetermined time interval and the dimming signal generator sets each of the dimming signals to a high level in response to a rising edge of a corresponding scan signal among the at least two scan signals, wherein a first one of the scan signals has a first riding edge, a sequential second one of the scan signals has a second rising edge after the first rising edge, a first one of the dimming signals transitions to a high level at the first rising edge and a sequential second one of the dimming signals transitions to the high level at the second rising edge.

6. The display apparatus of claim 5, wherein each of the scan signals has a duty ratio larger than 0 and smaller than 1.

7. The display apparatus of claim 6, wherein two of the scan signals adjacent each other have a phase difference corresponding to 1/N times one frame period, wherein N is the number of scan signals.

8. The display apparatus of claim 5, further comprising a global dimming part that outputs the global dimming signal to control the overall brightness of the backlight assembly.

9. The display apparatus of claim 8, wherein the clock generator receives the global dimming signal and adjusts the frequency of the dimming clock based on the duty ratio of the global dimming signal and the duty ratio of each of the scan signals.

10. The display apparatus of claim 9, wherein the clock generator outputs the dimming clock having a frequency corresponding to a first value divided by a second value, the first value obtained by multiplying the scanning frequency and the number of dimming steps, and the second value obtained by multiplying the duty ratio of each of the scan signals and the duty ratio of the global dimming signal.

11. The display apparatus of claim 5, wherein the each of the light emitting blocks includes a plurality of sub-blocks, and the sub-blocks included in each of the light emitting blocks are connected in parallel to each other.

12. The display apparatus of claim 11, wherein each of the sub-blocks comprises a plurality of light emitting diodes.

13. The display apparatus of claim 11, further comprising a voltage converting circuit converting an input voltage to a driving voltage to provide the driving voltage to an input terminal of each of the sub-blocks, and wherein the backlight control unit is connected to an output terminal of each of the sub-blocks to provide the dimming signal.

14. A backlight assembly comprising:

a plurality of light emitting blocks;

a scan signal generator sequentially outputting at least two scan signals having a scanning frequency synchronized with a frame frequency of a display;

a dimming step selector selecting a dimming step for each of the light emitting blocks among a plurality of dimming steps in response to local dimming data generated based on an image signal input to the display;

a clock generator converting a predetermined reference clock to a dimming clock, wherein a frequency of the dimming clock is a result of the scanning frequency being multiplied by the number of dimming steps and then being divided by a duty ratio of each scan signal, wherein the clock generator receives a global dimming signal to control an overall brightness of the backlight assembly and adjusts the frequency of the dimming clock based on a duty ratio of the global dimming signal; and a dimming signal generator counting the dimming step of each of the light emitting blocks using the dimming clock to generate dimming signals based on the counted values and the scan signals, wherein each of the at least two scan signals is successively output with a predetermined time interval and the dimming signal generator sets each of the dimming signals to a high level in response to a rising edge of a corresponding scan signal among the at least two scan signals, wherein a first one of the scan signals has a first riding edge, a sequential second one of the scan signals has a second rising edge after the first rising edge, a first one of the dimming signals transitions to a high level at the first rising edge, and a sequential second one of the dimming signals transitions to the high level at the second rising edge.

15. The backlight assembly of claim 14, wherein the dimming signals each have a dimming duty ratio corresponding to the dimming step of each of the light emitting blocks.

16. The backlight assembly of claim 14, wherein each of the light emitting blocks includes a plurality of sub-blocks, and the sub-blocks included in each of the light emitting blocks are connected in parallel to each other.

17. The backlight assembly of claim 16, further comprising a voltage converting unit providing a driving voltage to each sub-block based on the dimming signals.

18. The backlight assembly of claim 17, wherein the voltage converting unit comprises:

a DC/DC converter receiving an input voltage and providing the driving voltage; and a controller controlling the DC/DC converter based on the dimming signals.

19. The backlight assembly of claim 14, wherein the scan signal generator determines the frame frequency from an input scan synchronization signal the frequency of the scan synchronization signal depends on the number of light emitting blocks.

* * * * *